US005361827A

United States Patent [19]

Brown et al.

[11] Patent Number: 5,361,827

[45] Date of Patent: Nov. 8, 1994

[54] ECONOMIZER SYSTEM FOR VAPOR GENERATION APPARATUS

[75] Inventors: Richard D. Brown, Newington; Stephen M. Renals, Vernon, both of Conn.

[73] Assignee: Combustion Engineering, Inc., Windsor, Conn.

[21] Appl. No.: 998,160

[22] Filed: Dec. 29, 1992

[51] Int. Cl.[5] ..... F28F 27/02

[52] U.S. Cl. ..... 165/103; 165/921

[58] Field of Search ..... 165/103, 35, 921

[56] References Cited

U.S. PATENT DOCUMENTS

| | | | |
|---|---|---|---|
| 1,914,604 | 6/1933 | Keenan, Jr. et al. | 165/921 |
| 2,181,597 | 11/1939 | Cross | 165/921 X |
| 2,416,674 | 3/1947 | Bailey | 165/103 X |
| 2,582,830 | 1/1952 | Hawley | 165/103 X |
| 2,594,471 | 4/1952 | Marshall | 165/103 X |
| 2,947,522 | 8/1960 | Keller | 165/103 X |
| 3,007,681 | 11/1961 | Keller | 165/103 X |
| 3,396,781 | 8/1968 | Whetmore | 165/103 |
| 4,798,242 | 1/1989 | Kito et al. | 165/103 |
| 4,949,782 | 8/1990 | Braud | 165/34 |

*Primary Examiner*—John Rivell
*Assistant Examiner*—L. R. Leo
*Attorney, Agent, or Firm*—Robert S. Smith

[57] ABSTRACT

An economizer apparatus for a fossil fuel fired vapor generation apparatus which includes a housing having an inlet and an outlet and a wall extending generally between the inlet and the outlet to define first and second flow paths in the housing. The inlet may include means for connection to an associated vapor generation apparatus and means for connection to an associated stack. Heat exchange tubing is disposed in the first flow path having the interior thereof coupled to associated working fluid of the vapor generation apparatus. The apparatus also includes apparatus in the second flow path to control flow in the second flow path. In most embodiments of the invention the apparatus also includes a bypass conduit for selectively directing fluid flow around the heat exchange tubing. Ordinarily this will be desirable when the damper is obstructing fluid flow in the second flow channel.

2 Claims, 4 Drawing Sheets

ECONOMIZER SYSTEM FOR VAPOR GENERATION APPARATUS

BACKGROUND OF THE INVENTION

The invention relates generally to the art of vapor generation and is particularly concerned with an improvement in an economizer system for cooperation with vapor generation apparatus such as a steam generator. An economizer is a heat exchanger located somewhere in the flue gas passage between the boiler and the stack. The economizer is designed to recover some of the waste heat from the products of combustion. Typically an economizer has a series of tubes through which water or other working fluid flows on its way to the boiler. The tubes typically are arranged in a chamber having an inlet connected to a boiler and an outlet connected to a stack. Such devices are intended to recover heat that would otherwise be wasted. It is a design consideration in economizers systems to limit the minimum temperature of the flue gases exiting the economizer. This may be desirable to prevent corrosion or to insure proper operation of the stack.

Existing technology to control the minimum temperature of flue gases leaving the economizer includes a flue gas bypass duct that is external to the main body of the economizer. A damper is provided in the external flue gas bypass duct to control the flow in the bypass duct. Flue gases flowing through the bypass duct are mixed with gases that flow directly through the economizer at a point downstream of the main body of the economizer. This bypass duct system is very costly and presents design problems because of thermal expansion as very hot flue gas pass through the duct and because there may be fatigue life concerns since the duct may rapidly change from relatively low temperatures to relatively high temperatures a large number of times during the life of the duct.

It is an object of the invention to provide an economizer system for vapor generation equipment that is more simple and less expensive to the manufacture.

Another object of the invention is to provide apparatus which eliminates design problems inherent in a bypass duct with respect to thermal expansion and fatigue life.

Still another object of the invention is to provide apparatus which will maximize the mixing of flue gases exiting the economizer.

SUMMARY OF THE INVENTION

It is now been found these and other objects of the invention may be attained in an economizer apparatus for a fossil fuel fired vapor generation apparatus which includes a housing having an inlet and an outlet and a wall extending generally between the inlet and the outlet to define first and second flow paths in the housing. The inlet may include means for connection to an associated vapor generation apparatus and means for connection to an associated stack. Heat exchange tubing is disposed in the first flow path having the interior thereof coupled to associated working fluid of the vapor generation apparatus. The apparatus also includes means in the second flow path to control flow in the second flow path.

In some forms of the invention the apparatus further includes means for controlling flow of associated working fluid within the heat exchange tubing. The means for controlling flow of associated working fluid within the heat exchange tubing may be a valve.

BRIEF DESCRIPTION OF THE DRAWING

The invention will be better understood by reference to the accompanying drawing in which.

DESCRIPTION OF THE PREFERRED EMBODIMENT

Figure 1:
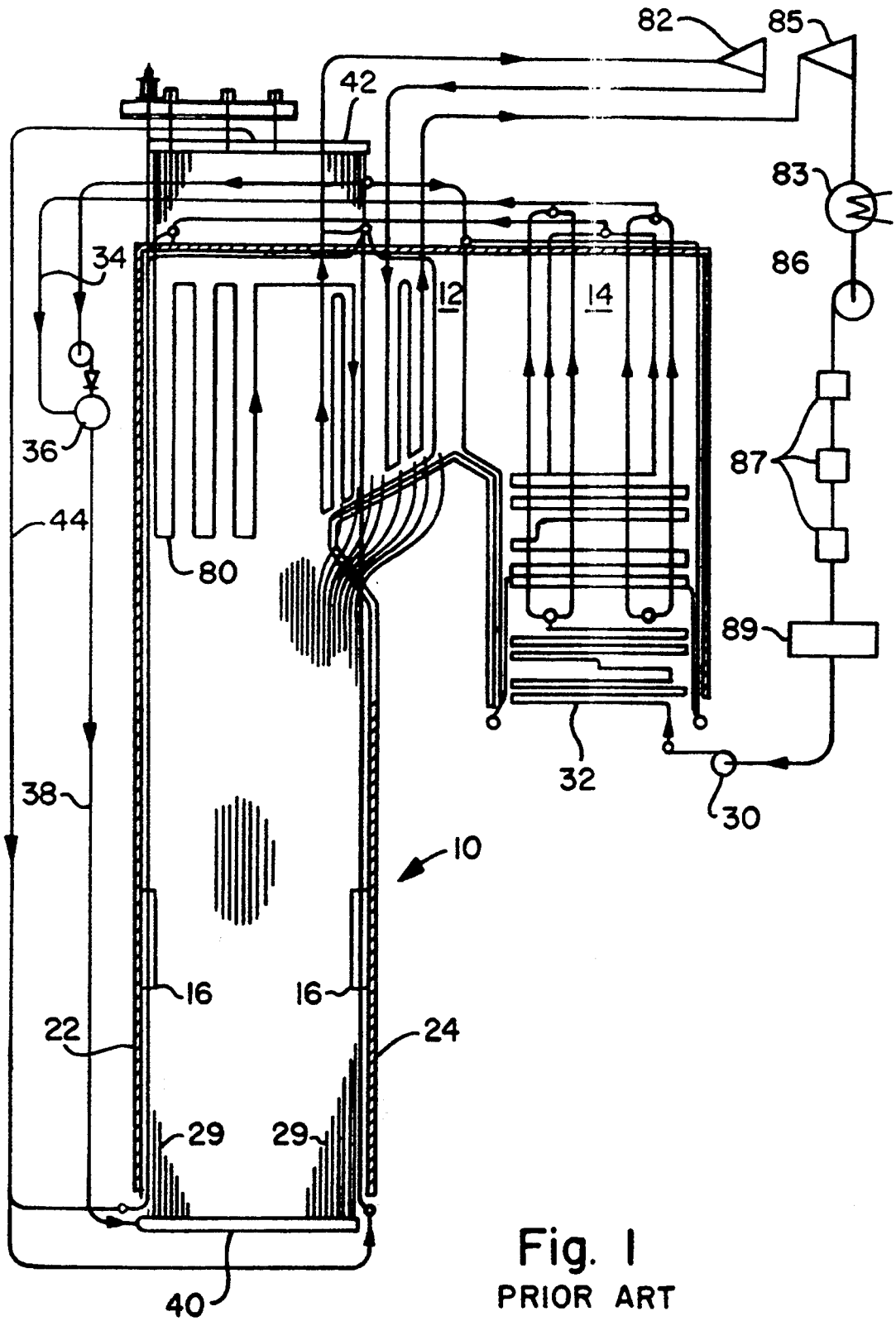
Fig. 1 PRIOR ART
FIG. 1 is a vertical sectional view of the vapor generation apparatus of the type in which the present invention has application.

Referring now to FIG. 1 there is shown a furnace 10 which is vertically disposed and has an outlet for combustion gases at its upper end extending from the rear wall thereof. Extending from this outlet is a lateral gas pass 12 which connects with the upper end of a vertically extended gas pass 14 that extends downwardly in parallel relation with the furnace 10. Combustion gases sequentially pass through the furnace 10, the lateral gas pass 12, a gas pass 14 and a stack (not shown). The illustrated furnace 10 is provided with burner 16. The furnace is made up of a front wall 22 and rear wall 24. Side walls (not shown) are disposed in spaced relationship and join the front wall 22 and the rear wall 24. In the vapor generation apparatus of FIG. 1, there is illustrated a once-through flow system that is comprised of a number of heat exchange portions or section which are connected in series flow relation and through which the through-flow is forced by means of feed pump 30. These heat exchange sections may be identified as an economizer, a wall tube heating section and a heating section comprising tubular members extending down into gas passage ways in the furnace. The feed pump 30 forces working medium through the economizer 32 which is comprised of numerous tubular elements in parallel flow relation and positioned generally at the lower end of gas pass 14. From the economizer 32 the fluid flow is diverted through a connecting link 34 to the mixing vessel 36. From this mixing vessel 36 the fluid flows down through the downcomer 38 to the inlet header 40 positioned at the bottom of a wall.

The exhaust from the second stage 85 of the turbine is received in a condenser 83 where the vapor is condensed and this condensate is pumped by a pump 86 through a feed water heater 87 and deaerator 89 to the inlet of the pump 30. The heat exchange tubing 102 extends in this prior art structure from the front wall 106 of the second pass 14 through the rear wall 108 of the second pass 14.

Figure 2:
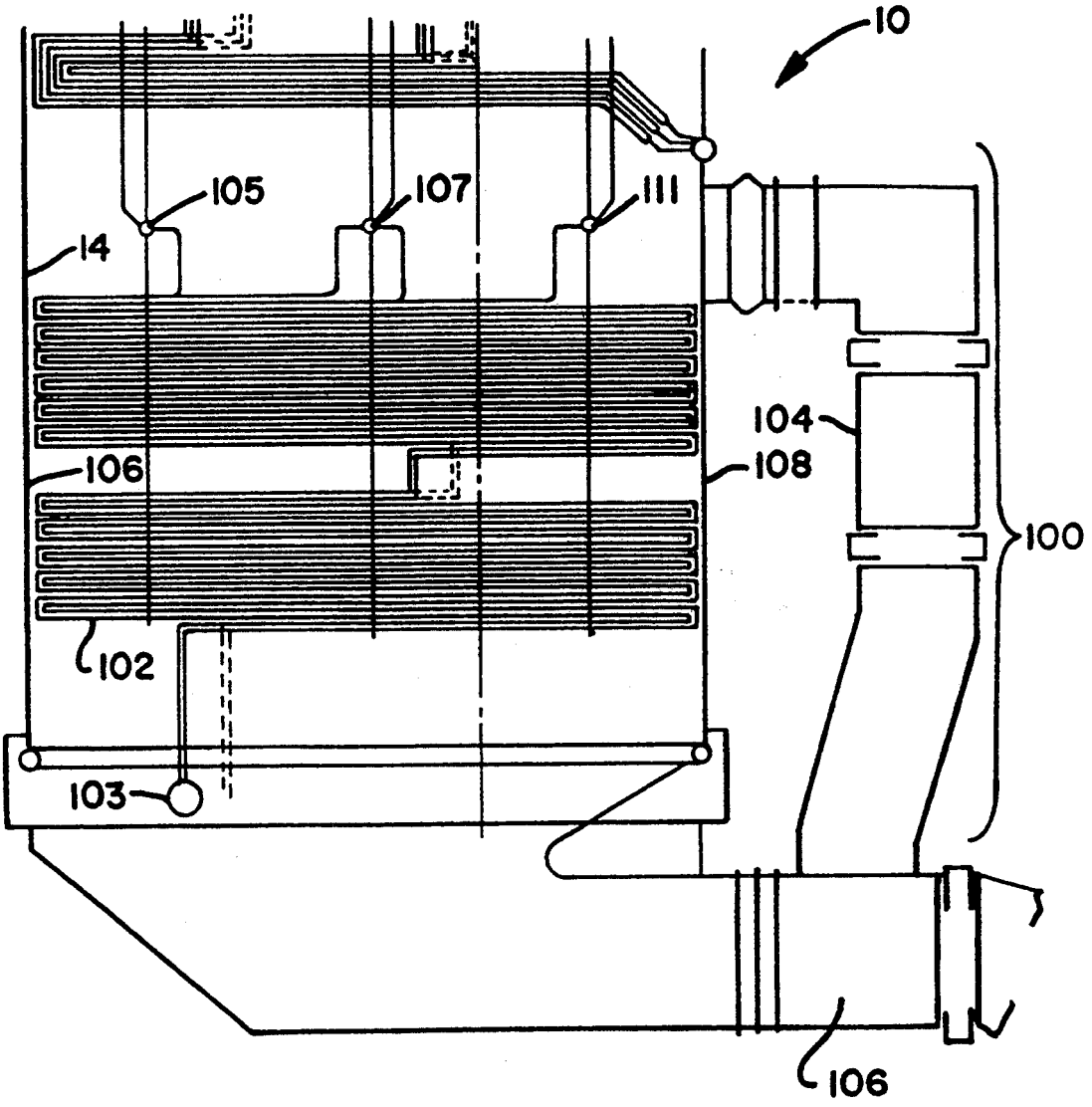
Fig. 2 PRIOR ART
FIG. 2 is a vertical sectional view of a prior art economizer incorporating flue gas bypass duct.

Referring now to FIG. 2 there is shown the prior art flue gas bypass duct economizer system 100. Disposed within the second pass 14 is tubing 102 through which the working fluid is directed. A bypass duct 104 connects the upstream portion of the second pass 14 to a stack connector 106. A damper (not shown) is provided within the bypass duct 104 to allow flue gases descending in the second pass 14 to either pass over the heat exchange tubing 102 and thus be cooled or alternately be directed through the bypass duct 104 where no such cooling occurs. In this manner the temperature in the duct 106 is maintained above the necessary minimum temperature. In the conventional apparatus the working fluid enters the tubing 102 at the inlet connection 103 and exits the economizer through the outlet connections 105, 107, 111.

Figure 3:
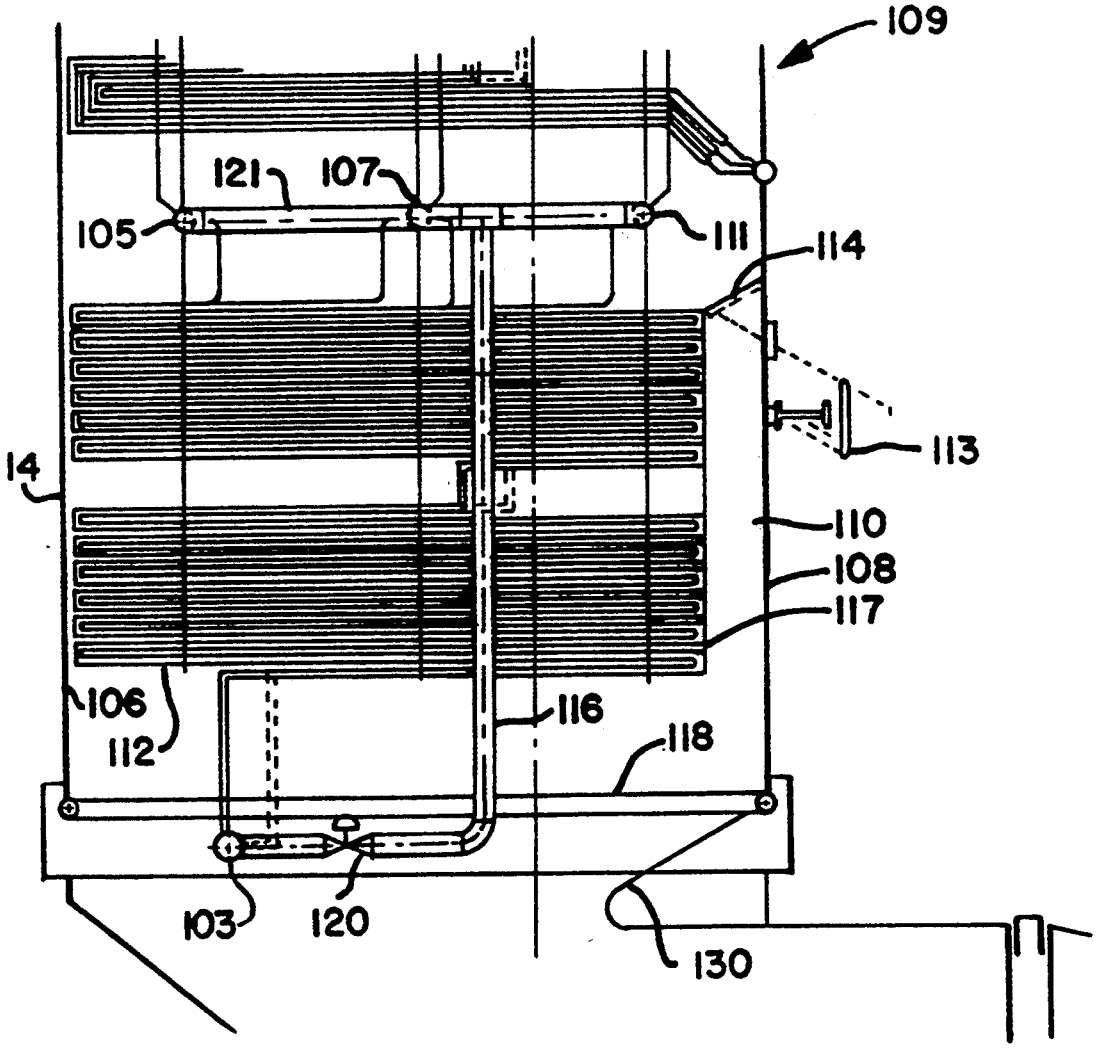
FIG. 3 is a vertical sectional view through the economizer system in accordance with the invention.

Referring now to FIG. 3 there is shown the economizer 109 system in accordance with the present invention. In this preferred form of the invention the heat exchange tubing 112 does not extend to the rear wall 108. A wall 117 defines a channel 110 that is an alternative flow path between the inlet and outlet of the economizer system 109. The channel 110 allows fluid flow to bypass the heat exchange tubing 112 within the second pass 14. The channel 110 between the heat exchange tubing 112 and the back wall 108 will have greater or lesser flow therethrough and thus greater and lesser flow bypassing the heat exchange tubing 112 depending upon the position of a damper 114 disposed at the upper axial end of the channel 110. The apparatus in FIG. 3 is further provided with a lever apparatus 113 for positioning the damper 114 thus to determine the amount of flow bypassing the heat exchange tubing 112.

Figure 4:
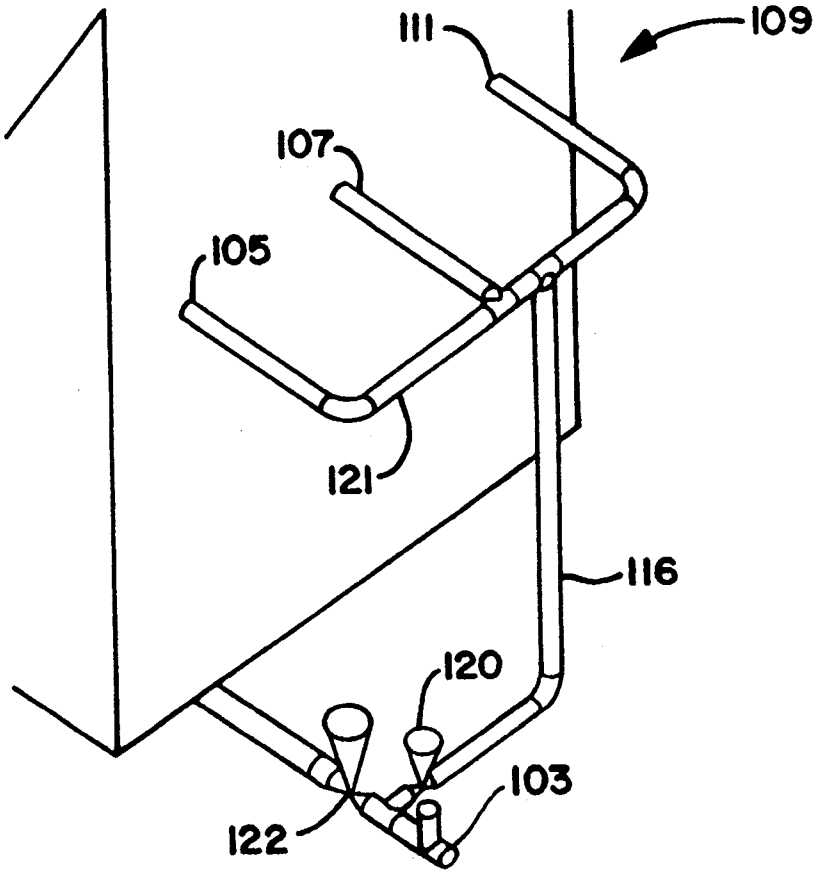
FIG. 4 is a simplified schematic view of the economizer system of FIG. 3 showing the working fluid bypass piping.

As best seen in FIG. 3 and 4 the economizer system 109 also includes a working lo fluid 116 and a manifold 121 in fluid communication therewith that bypasses the working fluid flow path between the inlet connection 103 and outlet connectors 105, 107, 111. It will be seen that a fluid bypass valve 120 controls bypass fluid flow to connections 105, 107, 111. It is this fluid flow that bypasses the heat exchange 14 tubing 112. A primary stop valve 122 is provided to interrupt fluid flow in the heat exchange tubing 112. A bypass control valve 120 modulates working fluid flow through pipe 116 and manifold 121 to the connectors 105, 107, 111.

In operation the economizer system 109 allows the operator of the furnace apparatus to raise the temperature of the flue gas leaving the economizer when load is reduced by means of simply opening the economizer bypass damper 114. If there is a further load reduction after the flue gas bypass damper 114 is fully open the main primary stop valve 122 is fully closed and the fluid bypass valve 120 is opened for additional control of the flue gas temperature leaving the economizer system 109. The procedure is reversed when load is increased. It is particularly desirable to have both the bypass for the working fluid, (the working fluid pipe 116 and manifold 121) and the channel 110 in the preferred form of the apparatus in accordance with the invention. In other applications only one such bypass arrangement may be sufficient.

It will seen that the apparatus in accordance with the invention substantially reduces the cost of the flue gas temperature control system. More specifically the conversion of existing equipment may be done with very conventional equipment such as piping and valves. The channel 110 in which the flue gas is bypassed around the heat exchange section 102 will have three walls that are exposed to steam and a fourth wall that is a partially cooled plate wall. Accordingly the technical concerns about thermal cycling are eliminated and the design of the apparatus for thermal expansion is greatly simplified. This is in contrast to the prior art ducts described above that are exposed to substantial thermal cycling problems.

It will also be seen that the flue gas bypass system in accordance with the present invention is located near the nose 130 to maximize mixing of the flue gases having different temperatures. Accordingly, the apparatus in accordance with the invention thus takes advantage of the existing nose 130 construction. It will seen that fluid flow through the bypass channel 110 is directed laterally by the nose 130 to foster through mixing of the flue gases having different temperatures.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described our invention we claim:

1. An economizer system for a fossil fuel fired vapor generation apparatus which comprises:

a housing having an inlet and an outlet and a wall extending generally between said inlet and said outlet to define first and second flow paths in said housing, said inlet including means for connection to an associated vapor generation apparatus, said apparatus including means for connection to an associated stack;

heat exchange tubing disposed in said first flow path having the interior thereof coupled to associated working fluid of said vapor generation apparatus, said heat exchange tubing having an inlet and an outlet;

means for controlling flow of associated working fluid within said heat exchange tubing being a first valve;

means for selectively bypassing working fluid around said heat exchange tubing, said means for selectively bypassing working fluid includes a conduit having first and second ends, said first and second ends being disposed respectively in fluid communication with said inlet and said outlet of said heat exchange tubing;

means in said second flow path to control flow in said second flow path which comprises a second valve;

said housing has a nose portion that tapers generally radially inwardly, said second flow path in said housing is disposed to direct flow against said nose port whereby fluid mixing is greater between fluid streams in said first flow path and said second flow path.

2. The apparatus as described in claim 1 wherein:

said conduit includes a manifold making a plurality of connections to said heat exchange tubing.

* * * * *